US007508405B2

(12) United States Patent
Kunde et al.

(10) Patent No.: US 7,508,405 B2
(45) Date of Patent: Mar. 24, 2009

(54) THERMOTRANSFER PRINTER, AND METHOD FOR CONTROLLING ACTIVATION OF PRINTING ELEMENTS OF A PRINT HEAD THEREOF

(75) Inventors: Christoph Kunde, Berlin (DE); Raimund Nisius, Berlin (DE); Frank Reisinger, Oranienburg (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 388 days.

(21) Appl. No.: 11/290,389

(22) Filed: Nov. 30, 2005

(65) Prior Publication Data

US 2006/0139436 A1 Jun. 29, 2006

(30) Foreign Application Priority Data

Nov. 30, 2004 (DE) ..... 10 2004 060 156
Dec. 29, 2004 (DE) ..... 10 2004 063 756

(51) Int. Cl.
*B41J 2/36* (2006.01)

(52) U.S. Cl. ..... 347/188

(58) Field of Classification Search ..... 347/188; 400/120.09

See application file for complete search history.

(56) References Cited

U.S. PATENT DOCUMENTS 4,737,860 A * 4/1988 Ono et al. ..... 347/192
5,079,565 A 1/1992 Shimizu et al.
5,400,058 A 3/1995 Helmbold et al.
5,452,095 A * 9/1995 Ono et al. ..... 358/296
5,534,890 A 7/1996 Krug et al.
5,564,841 A 10/1996 Austin et al.
5,765,953 A 6/1998 Takahashi

FOREIGN PATENT DOCUMENTS

EP 0 516 247 12/1992
GB 2 169 771 7/1986

OTHER PUBLICATIONS

Patent Abstracts of Japan Publication No. 63077756 A, published Apr. 1988.
Patent Abstracts of Japan Publication No. 61241165 A, published Oct. 1986.

* cited by examiner

*Primary Examiner*—Huan H Tran
(74) *Attorney, Agent, or Firm*—Schiff Hardin LLP

(57) ABSTRACT

In a printer and a method for control of the print head thereof operating according to the thermotransfer principle, the print head having a number of printing elements for which an energy quantity to be supplied to one of the printing elements is determined in a determination step and the energy quantity is supplied to that printing element in a supply step in order to transfer ink from an ink carrier device associated with the print head onto a substrate associated with the ink carrier device, by the energy quantity is determined in the determination step dependent on the print image type of the print image in the region of the image point.

38 Claims, 4 Drawing Sheets

THERMOTRANSFER PRINTER, AND METHOD FOR CONTROLLING ACTIVATION OF PRINTING ELEMENTS OF A PRINT HEAD THEREOF

BACKGROUND OF THE INVENTION

1. Field of the Invention

The present invention concerns a method for controlling a print head of the type operating with a number of printing elements according to the thermotransfer principle, in which method an energy quantity to be supplied to a printing element in a first supply step is determined in a determination step, the energy quantity being supplied to the printing element in order to transfer ink from an ink carrier device associated with the print head onto a substrate associated with the ink carrier device for generation of an image point of a print image. The invention concerns a printer that is suitable for implementation of the inventive method.

2. Description of the Prior Art

In order to obtain a qualitatively high-grade image in such thermotransfer printers known, for example, from EP 0 536 526 A2, each printing element of the print head must be supplied with a relatively precisely quantified energy in order to reliably melt the ink particles from the carrier material of the ink ribbon to the desired quantity or spatial expansion. Depending on the current temperature of the respective printing element, more or less energy must be supplied in order to achieve the optimal melting temperature.

The control of the printing elements is normally optimized at the factory for a specific ink ribbon type with a specific ink. To determine the required energy quantity for a respective image point (pixel) of the print image to be generated, a predetermined determination algorithm and a correspondingly set print parameter set are normally used.

A problem is that different requirements for the consistency [quality; condition] of the image points generated on the substrate exist for different types of print images. Particularly for images known as two-dimensional barcodes, high requirements exist for sharpness and contrast in the region of the edges of the rectangles or squares generated via the image points. This applies both in the printing direction and transversely thereto. By contrast, these strict requirements typically exist only in one direction (normally the printing direction) in images known as one-dimensional barcodes. Other requirements must be set for text or free graphics.

In order to satisfy these different requirements to the greatest extent possible, a compromise solution or a solution matched to a specific print image type is selected, but this leads to less satisfactory results, for example in regions of a mixed print image with different print image types.

Alternatively, it is possible to set an activation of the print head used for all print image types, this activation supplying a satisfactory result for the print image type with the highest requirements. From an economic point of view, however, this is normally undesirable because an increased expenditure occurs in regions with lesser requirements.

SUMMARY OF THE INVENTION

An object of the present invention is to provide a method and a printer of the above-described type that do not exhibit, or exhibit to a lesser degree, the disadvantages described above, and that in particular enable a simple and economic improvement of the print image quality in the printing of images of different print image types.

In the inventive method and printer, a simple improvement of the print image quality is enabled for print images of different print image types by the energy quantity being determined in the determination step, in the region of the image point, dependent on the print image type of the print image.

It is thus possible in a simple manner to achieve an optimized print quality for print images of different print image types and mixed print images with regions of different print image types.

The inventive method can be applied when entire print images are printed with alternating print image types. Moreover, the method can be used when the first print image contains regions of respectively different print image types. The energy quantity is then preferably determined dependent on the print image type of the region with which the image point is associated.

The energy quantity can be determined in any suitable manner. Different print parameters and/or different determination algorithms can be provided for determination of the first energy quantity for different print image types.

For this purpose, preferably the energy quantity is determined in the determination step using a print parameter set dependent on the print image type at the location of the first image point.

The print parameters contained in the print parameter set can be any parameters that can be used for determination of the correct control values for the printing elements. For example, they can directly be voltages and/or currents and/or pulse durations etc. that can be directly used for control of the printing elements. The print parameter set preferably is an energy parameter set because the corresponding activation parameters can be quickly calculated therefrom independent of the design of the print head.

Preferably, energy quantity is determined in the determination step using a print parameter set formed of partial parameter sets respectively associated with different print image types and the energy quantity is determined using at least the partial parameter set that is associated with the print image type at the location of the image point.

In other versions of the inventive method, the energy quantity is determined in the determination step using a determination algorithm, with determination algorithms, respectively associated with different print image types being provided and the energy quantity being determined using at least the determination algorithm that is associated with the print image type at the location of the first image point. The respective determination algorithm thus, for example, can operate with the same print parameter set. In the simplest case, the determination algorithms only differ by factors or summands. However, it is also possible for the respective determination algorithms to differ in their fundamental makeup.

The determination of the energy quantity can ensue such that respectively only the energy quantity corresponding to the print image type at the location of the image point is determined in the determination step. In other words, in the determination step a single correct control set with the energy quantities for all image points of the specific print image to be generated can be directly generated.

In other versions of the invention, for the image point, an energy quantity for a number of or for all different print image types is determined, and a selection of that energy quantity being associated with the print image type at the location site of the image point and to be used in the supply step, then only ensuing in a selection step following the determination step. In other words, a number of control sets with the energy quantities for all image points of the print image to be generated can be generated for a specific print image with the parameters or determination algorithms for different print image types. From among these control sets, at a later point in time, the control set that corresponds to the print image type at the location of the respective image point is then selected and used.

In further embodiments of the inventive method, a print parameter set that is characteristic of the ink carrier device is initially read from a memory associated with the ink carrier device and the first energy quantity is then determined using at least this print parameter set.

The association of the memory with the ink carrier device enables the memory to be exchanged together with the ink carrier device. Energy parameters precisely matched to the ink carrier device currently in use thus can be automatically used as needed in a simple manner. Among other things, it is possible to use ink carrier devices with different inks without complicated modification of the firmware of the control of the print head being necessary for this purpose.

A print parameter set that is characteristic for the ink carrier device can be read from a memory associated with the ink carrier device in a read step preceding the determination step, and the energy quantity can be determined in the determination step using at least the print parameter set.

The memory can be associated with the ink carrier device in any suitable manner. It need only be ensured that the first memory can be read out by the print head controller at or after the association of the ink carrier device with the print head. The print parameter set therefore preferably is read out from the memory in the read step, with memory arranged on the ink carrier device.

The memory can be any suitable memory and can be read out in any suitable manner. For example, it can be one or more electronic, electromagnetic, or optical storage module etc. Preferably one or more memory chips can be contacted and read by suitable means, but alternatively suitably coded marking can be used, the information thereof being recorded in an optical manner.

The ink carrier device likewise can be any suitable device with an ink carrier carrying the ink to be applied. For example, the ink carrier device can be an ink ribbon cassette with an ink ribbon as the ink carrier.

This ink carrier device can be exchangeable in any suitable manner, i.e. it can be designed to be removed from the print head. If a new ink carrier device is associated with the print head, for example a new ink ribbon cassette is inserted, as mentioned a connection with the memory preferably is automatically established in order to be able to read print parameters from the print parameter set. This can ensue, for example, through corresponding contact elements on the ink carrier device that are automatically contacted with the printer upon mounting of the ink carrier device.

The print parameter set preferably includes at least one partial parameter set that in turn includes at least one print parameter as a function of at least one state parameter that predominates in the region of the print head. It is thereby possible to quickly and simply react to different states of the printer or its environment, for example to different temperatures or print speeds.

The print parameter can be stored as a continuous function of the appertaining state parameter. Alternatively, in further embodiments of the inventive method, the partial parameter set for a number of discrete values of the state parameter includes at least one associated print parameter value, such that the appertaining print parameter value can be directly extracted from the partial parameter set if necessary without further calculations.

A high number of value pairs can be provided in order to extract the appertaining print parameter value directly from the partial parameter set with sufficient precision. In order to reduce the memory storage requirements preferably intermediate values of the print parameter value is determined by interpolation in the determination step for values of the state parameter lying between the discrete values of the state parameter.

The state parameter can be an arbitrary state parameter that influences the print event or its result. The state parameter preferably is a temperature in the region of the print head, since this has direct influence on the additional energy to be expended for the printing. The state parameter likewise can be the speed of the printing medium (for example a substrate to be printed) relative to the printing element and/or the ink carrier device. For example, this can be the feed speed of the medium to be printed or the relative speed between the print head and ink carrier etc.

As explained above, in the printing event each printing element must be supplied with a relatively precisely qualified energy in order to reliably melt the ink particles from the ink carrier in the desired quantity or spatial expansion. Depending on the current temperature of the printing element, more or less energy must be supplied in order to achieve the optimal melting temperature.

The current temperature of the printing element cannot be directly determined, or can be directly determined only with significant effort. Among other things, this depends on the temperature of the surrounding region of the print head, as well as on the energy previously supplied to the respective printing element. In preferred embodiments of the inventive method, the energy feed to the first printing element that has occurred in one feed step preceding the current feed step is taken into account in the determination step. With this consideration of the previous printing history, it is possible to estimate the energy necessary for the optimal printing with simple means and high precision.

Depending on the control of the printing elements, the determination of the energy necessary for the optimal printing can ensue before the printing event for the entire print image. The energy feed that is to occur to at least the printing element in at least one feed step preceding the current feed step is then taken into account in the determination step. If the determination of the energy necessary for the optimal printing ensues during the print event, the feed that has occurred to at least the printing element in at least one feed step preceding the current feed step is then possibly taken into account in the determination step.

It can suffice to only account for the printing element in question, but one or more adjacent printing elements preferably are also considered in order to estimate the energy supplied thereby. The energy feed that has occurred or the energy feed that is ensued to at least one further printing element adjacent to the printing element in question in at least one feed step preceding the first feed step is therefore preferably considered in the determination step.

Here preferably, the energy feed that has occurred or that is to occur to the printing element and/or its neighbors in the last feed step before the current feed step is considered. The occurred energy feed or the energy feed to ensue to the printing element and/or its neighbors in the penultimate feed step before the current feed step is furthermore preferably taken into account. Particularly good estimates of the optimal energy quantity to be supplied can be achieved thereby.

In preferred embodiments of the inventive method with consideration of the previous printing history, the print parameter set includes a number of energy feed values for different energy feed constellations in at least one preceding feed step. The respective energy value to be fed to the printing element can be calculated from this information in a simple manner, dependent on the detected or registered previous printing history.

The energy quantity preferably is determined in the determination step using at least the print parameter set, as a reduction from a predetermined maximum energy quantity to be supplied being subtracted for the energy feed that occurred in at least one preceding feed step at least to the printing element. The required optimal energy quantity thus can be determined particularly simply and quickly.

The present invention furthermore concerns a printer with a printing device operating according to the thermotransfer principle, the printing device having a print head with a number of printing elements and a processing unit connected with the print head for control of the print head. Furthermore, the printer also has an ink carrier device (preferably removable) associated with the print head. The processing unit is fashioned for determination of the energy quantity to be supplied to one of the first printing elements and for triggering the feed of the energy quantity to the printing element in order to transfer ink from the ink carrier device to a substrate associated with the ink carrier device for generation of a image point of a print image. According to the invention, the processing unit is fashioned for determination of the energy quantity dependent on the print image type of the first print image in the region of the image point.

This printer is suited for implementation of the inventive method. With it the advantages and variants of the inventive method described above can be achieved to the same degree.

The print image preferably has regions of different print image types, and the processing unit is fashioned to determine the energy quantity dependent on the print image type of the region that is associated with the image point. The processing unit preferably uses at least one print parameter set.

This print parameter set preferably contains partial parameter sets associated with different print image types, and the processing unit is designed to determine the energy quantity using at least the partial parameter set that is associated with the print image type at the location of the image point. Determination algorithms associated with different print image types can additionally or alternatively be provided and be used by the processing unit for determination of the energy quantity in the manner described above.

In embodiments of the inventive printer, a memory associated with the ink carrier device is provided in which a print parameter set is stored that is characteristic of the ink carrier device. Furthermore, the processing unit is designed to read the print parameter set as well as to determine the energy quantity using at least the print parameter set.

As described above, the memory therefore is preferably connected with the ink carrier device. Furthermore, the processing unit preferably is designed for the determination (described above) by interpolation of intermediate values of the print parameter value for values of the state parameter lying between the discrete values of the state parameter.

In order to be able to account for the previous printing history as described above, the processing unit is designed to account for the energy feed to at least the printing element that has occurred earlier. The processing unit furthermore is designed to account for the energy feed that has previously occurred to at least one further printing element adjacent to the printing element in question. The processing unit preferably is designed to account for the last occurring energy feed and/or to account for the penultimate occurring energy feed.

Furthermore, the processing unit is designed to read the memory in a read step initiated by at least one predeterminable event. Such a predeterminable event can be any temporal or non-temporal event. For example, the event can be the reaching of specific, predeterminable points in time. The event can likewise be the occurrence of a specific predeterminable operating state of the printer. The read step thus can ensue, for example, at each n-th activation (with n=1, 2, 3 etc.). The event naturally also can be a specific input of a user or from a remote data center.

The event preferably is the connection of the memory with the processing unit. In other words, the read step ensues triggered by the connection of the memory with the processing unit. This ensures that the correct printing parameters are read and provided for control upon each new or repeated use of an ink carrier device.

The print parameter set or individual print parameters can be read out again from the memory upon each activation. The first print parameter set is preferably read out from the memory in the read step and stored in a further memory connected with the processing unit, this further memory then being accessed for activation in the further method workflow. Faster processing times thereby can be achieved because such a further memory in the printer (for example a faster working memory that is often present anyway in the printer) can be addressed faster. The expenditure for the initially described memory (in particular its fast address capability) then can be kept low.

The inventive printer can be used for arbitrary applications, but can be used particularly advantageously in connection with a franking machine. This in particular applies when, as described above, different print image-dependent print parameters are used. In a franking machine this can occur, for example, when different print parameters than are used in the generation of text or free graphics, and for the generation of one-dimensional or two-dimensional barcodes. The inventive printer is preferably fashioned as a printer unit of a franking machine.

The present invention accordingly furthermore concerns a franking machine with an inventive printer. The present invention furthermore concerns an ink carrier device (in particular ink ribbon cassette) for an inventive printer that exhibits the features of the ink carrier device described above in connection with the inventive printer. The invention furthermore concerns a printing device for an inventive printer which exhibits the features of the printing device described above in connection with the inventive printer.

DESCRIPTION OF THE PREFERRED EMBODIMENTS

Figure 1:
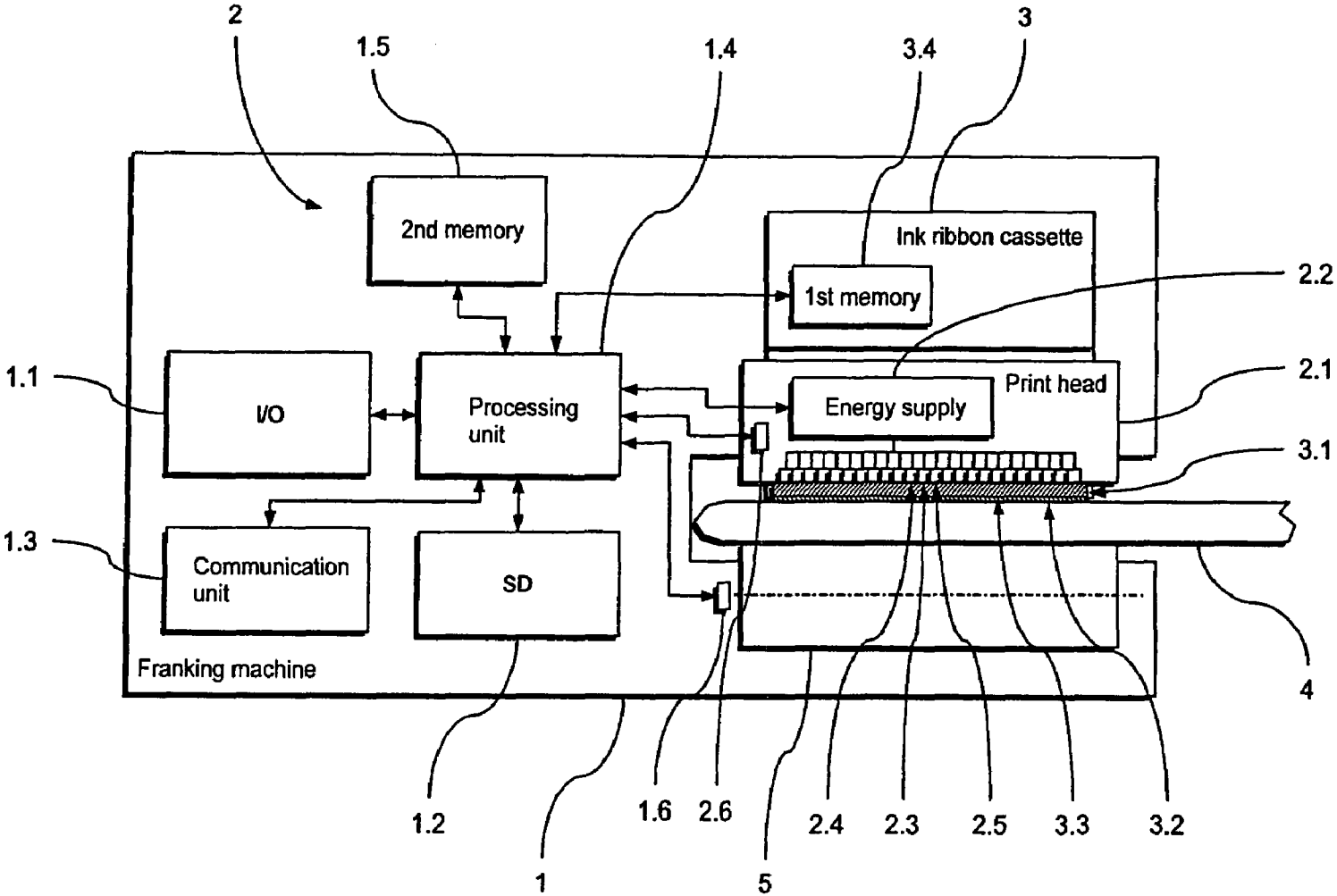
FIG. 1 schematically illustrates a preferred embodiment of the inventive printer with which a preferred embodiment of the inventive method for activation of a print head can be implemented.

FIG. 1 schematically shows a franking machine 1 with a preferred embodiment of the inventive printer 2. The printer 2 is operated according to a preferred embodiment of the inventive method for operation of a printer. A preferred embodiment of the inventive method for activation of a print head is also hereby used.

The printer 2 forms the printer unit of the franking machine 1. In addition to the printer 2, the franking machine 1 has further components such as, for example, an input/output unit 1.1, a security module 1.2 in the form of what is known as a PSD or SAD (what is known as an SD for short) and a communication unit 1.3.

A user can enter information into the franking machine 1 and information can be output to the user via the input/output unit 1.1, for example a module with keyboard and display. The security module 1.2 provides security functionalities for physical and logical securing of the security-relevant data of the franking machine 1. The franking machine 1 can be connected, for example, with remote devices (for example a remote data center) over a computer network via the communication unit 1.3.

Among other things, the printer 2 has a processing unit 1.4, a print head 2.1 and an ink carrier device in the form of an ink ribbon cassette 3. The processing unit 1.3 is a central processing unit of the franking machine 1 which, in addition to other functions, assumes the control of the print head 2.1 for printing.

The print head 2.1 has an energy supply device 2.2 that supplies a series of n printing elements 2.3, 2.4, 2.5 with energy. The energy supply device 2.2 is controlled by the processing unit 1.4 for this purpose.

The ink ribbon cassette 3 is associated with the print head 2.1 such that its ink ribbon 3.1 contacts the printing elements 2.3, 2.4, 2.5 of the print head 2.1 at its back side. For printing, the printing elements 2.3, 2.4, 2.5, controlled by the processing unit 1.4, are respectively supplied by the energy supply device 2.2 with a precisely-quantified energy quantity in order to locally melt ink particles of the ink layer 3.2 that is located on the ink carrier 3.3 of the ink ribbon 3.1. These ink particles are then transferred onto a substrate 4, for example a letter to be franked. For this purpose, the letter 4 is fed past the print head 2.1 and is pressed by pressure rollers against the ink ribbon 3.1 situated between them.

The ink ribbon cassette 3 has a first memory 3.4 that is automatically connected with the processing unit 1.4 by corresponding contact elements upon association of the ink ribbon cassette 3 with the printer 2, in other words upon insertion of the ink ribbon cassette 3 into the franking machine 1. The print parameters associated with the ink ribbon cassette 3 are stored in the first memory 3.4 as a first print parameter set. These print parameters are (as explained in the following) used for control of the print head 2.1.

Figure 3:
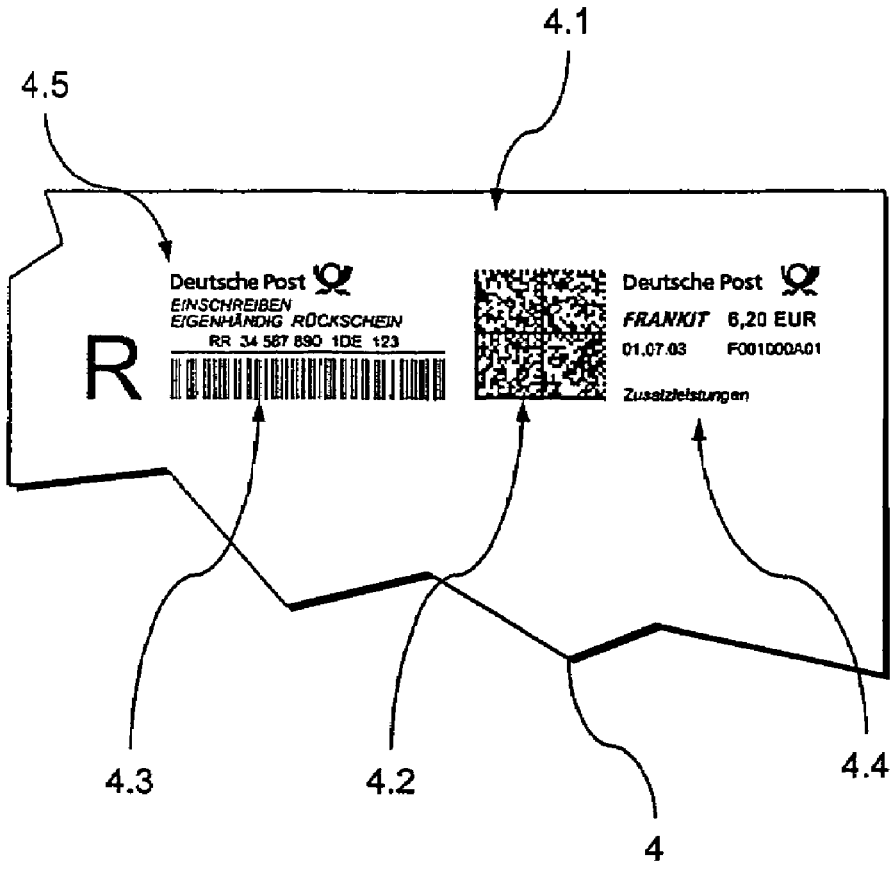
FIG. 3 schematically illustrates a print image that is generated with the printer of FIG. 1 using the inventive method.
Figure 4:
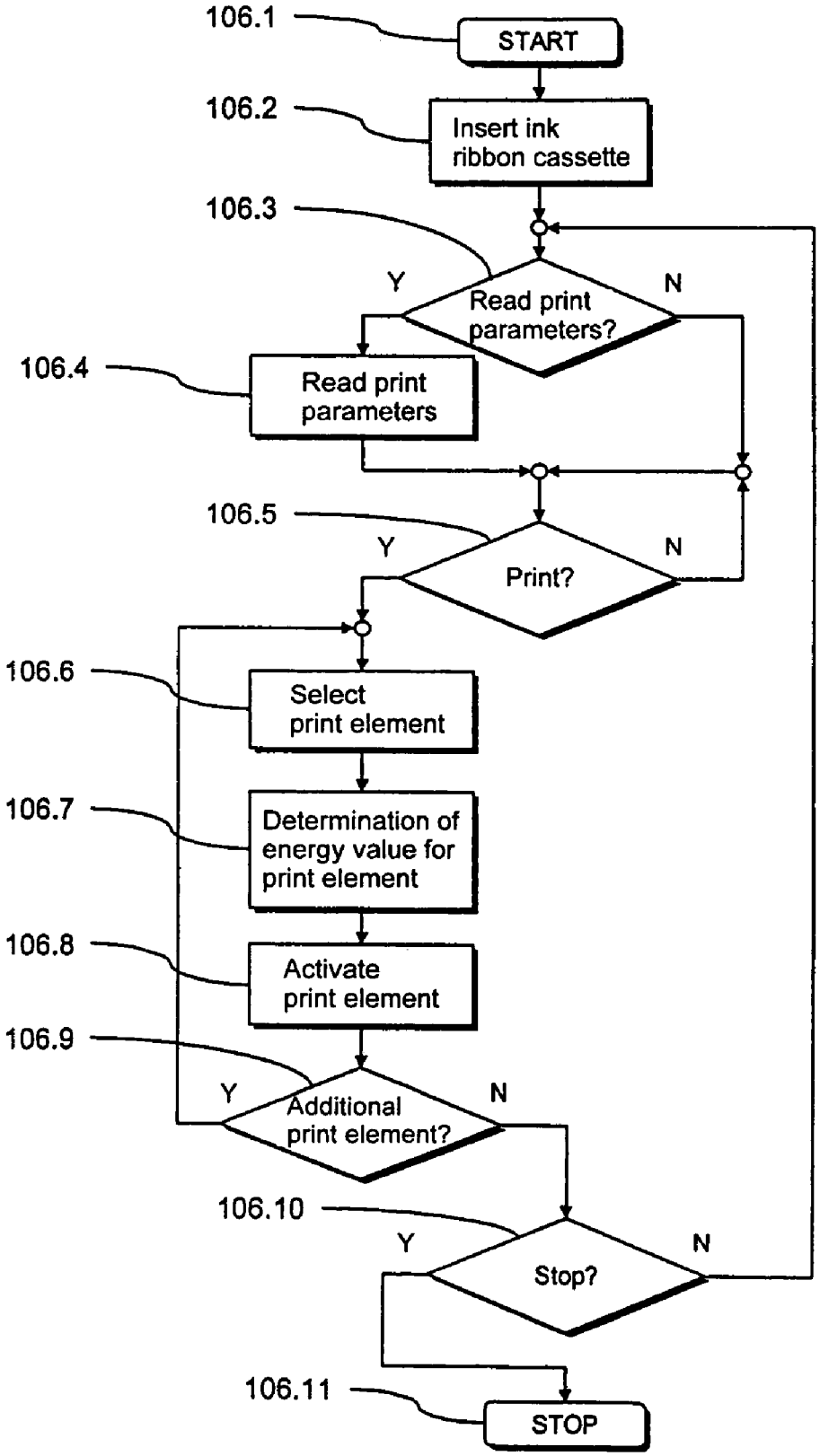
FIG. 4 is a flowchart of a further embodiment of the inventive method for operation of a printer using a preferred embodiment of the printer of FIG. 1.

FIG. 3 shows a print image in the form of a franking imprint 4.1 according to the specifications of the Deutsche Post AG, the franking imprint 4.1 being generated on the letter 4 with the print head 2.1. The franking imprint 4.1 contains different sub-regions 4.2 through 4.5 of different print image types. The first sub-region 4.2 is a two-dimensional barcode and the second sub-region 4.3 is a one-dimensional barcode, while the third and fourth sub-regions 4.4 and 4.5 are each regions with text and free graphics.

Different requirements with regard to the sharpness and contrast of the print image 4.1 exist for its sub-regions of different print image types. High requirements for sharpness and contrast thus exist for the two-dimensional barcode 4.2 in the region of the edges of the rectangles or squares generated via the image points. This applies both in the printing direction as well as transverse thereto. By contrast, for the one-dimensional barcode 4.3 these strict requirements exist only in one direction (normally the printing direction). Other requirements exist for the text or free graphics of the sub-regions 4.4 and 4.5. The present invention accounts for these by the control of the print head 2.1 ensuing dependent on the print image type at the site of the respective image point to be generated.

Figure 2:
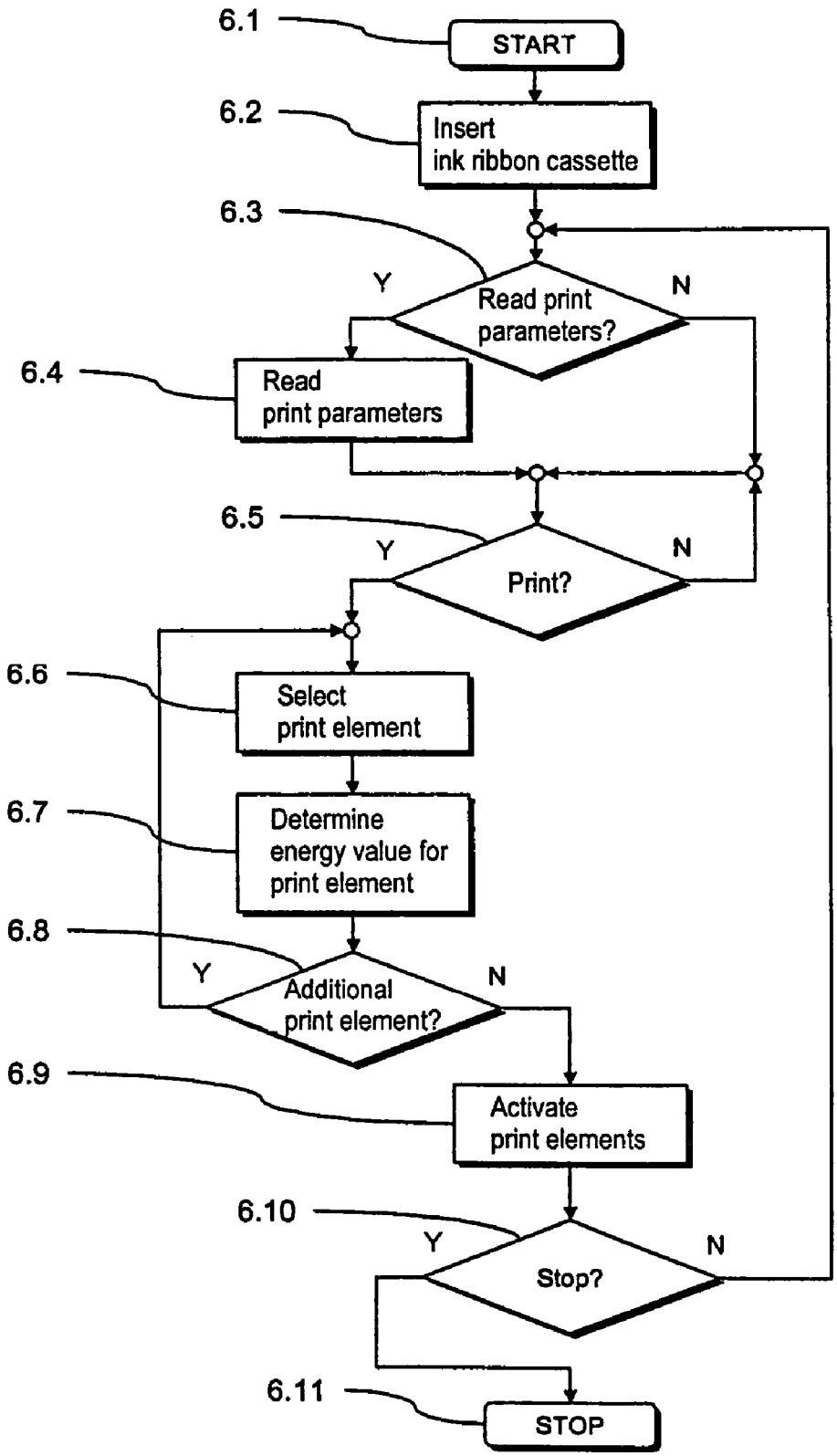
FIG. 2 is a flowchart of an embodiment of the inventive method for operation of a printer using a preferred embodiment of the printer of FIG. 1.

In the following, a preferred embodiment of the inventive method for operation of a printer using a preferred embodiment of the inventive method for control of a print head, which method is implemented with the printer 2 of FIG. 1, is described with reference to FIGS. 1 through 3.

The method workflow is initially started in a step 6.1. In a connection step 6.2, the ink ribbon cassette 3 is inserted into the franking machine 1 such that it is correctly associated with the print head 2.1. As described above, the first memory 3.4 is automatically connected with the processing unit 1.4 by corresponding contact elements.

In a step 6.3, the processing unit 1.4 checks whether a reading of the print parameters from the first memory should ensue. This is the case when the described insertion of an ink ribbon cassette 3 has been detected as a first event. It is likewise established that the reading should ensue after each activation of the franking machine 1. The activation of the franking machine 1 thus likewise represents an event triggering the reading of the print parameters. It is hereby understood that, in other variants of the invention, other temporal or non-temporal events can also be defined which trigger the reading of the print parameters as this has already been described above.

If the reading of the print parameters should ensue, the processing unit 1.4 automatically reads the first print parameter set from the first memory 3.4 in a read step 6.4. The processing unit 1.4 thereby stores the parameter set in a second memory 1.5 (in the form of a volatile working memory of the franking machine 1) connected with the processing unit 1.4. It is understood that, in other variants of the invention, the second memory 1.5 can be a non-volatile memory. Moreover, it can then suffice to read the print parameters from the first memory 3.4 only at every detected insertion of an ink ribbon cassette.

In a step 6.5, it is checked whether a printing process should be implemented, for example whether a letter 4 should be franked. If this is the case, in a step 6.6 the first printing element of the print head 2.1 to be activated is initially selected according to the print image to be generated.

In a determination step 6.7, the processing unit 1.4 then estimates, with access to the first print parameter set stored in the first memory 1.5, the optimal energy quantity with which the selected printing element must be supplied in order to generate a qualitatively high-grade franking imprint on the letter 4.

In order to enable a determination of the optimum first energy quantity that is adapted to the print image type, the first print parameter set includes a separate partial parameter set for each print image type to be expected. In the present case, this is a first partial parameter set for the print image type "two-dimensional barcode," a second partial parameter set for the print image type "one-dimensional barcode" and a third partial parameter set for the print image type "text and free graphics".

Depending on which print image type is associated with the location of the currently-considered first image point of the first print image, the processing unit 1.4 accesses the partial parameter set of the first print parameter set that is associated with this print image type in order to estimate the optimal first energy quantity. The estimation of the first energy quantity is explained in further detail in the following.

It is understood that, in other variants of the invention, the determination of the optimal first energy quantity that is adapted to the print image type can also be achieved by using various determination algorithms for the optimum first energy quantity in addition or as an alternative to the use of partial parameter sets associated with the respective print image type. Different determination algorithms are then associated with different print image types and used by the processing unit dependent on the print image type of the current image point.

In a step 6.8, the processing unit then checks whether a further printing element of the print head 2.1 is to be activated. If this is the case, the process jumps back to step 6.6, in which the next printing element of the print head 2.1 to be activated is then selected.

All optimal energy quantities for the printing elements are determined beforehand in this manner for the print image to be created. In other words, the activation sequences for the print head 2.1 are determined beforehand.

In a step 6.9 comprising all supply steps for the print image to be generated, the processing unit 1.4 then controls the energy supply device 2.2 such that the corresponding first energy quantity is respectively supplied to the individual printing elements. The determination of the energy quantities beforehand for the entire print image has the advantage that a faster printing process can be achieved.

It is understood that, in other variants of the invention, not just one optimal first energy quantity is determined using a partial parameter set of the first print parameter set that corresponds to the current print image type. Rather, a separate optimal first energy quantity can be calculated for each partial parameter set. Given the three different print image types of the first print image 4.1 (two-dimensional barcode, one-dimensional barcode, text/free graphics), three optimal first energy quantities are thus calculated per image point using the respective partial parameter sets.

In this manner, activation sequences for the print head 2.1 that are associated with the last three different print image types are determined for the print image 4.1 in these variants. In the step in which the energy feed to the individual printing elements then ensues, a selection of the corresponding activation sequence can be made in a selection step dependent on the print image type of the current image point, from which corresponding activation sequence the actual optimum first energy quantity to be used for this image point is then taken.

The printing ensues in columns. All printing elements of the print head 2.1 to be activated according to the print image to be generated are thereby activated in an activation sequence for generation of a print column. In a further activation sequence, all printing elements of the print head 2.1 to be activated according to the print image to be generated are then activated in turn for generation of the next print column.

If no further printing element is to be activated, for example because all columns of the print image have been printed or a termination has occurred, in a step 6.10 it is finally checked whether the method workflow should be ended. If this is the case, the method workflow ends in a step 6.1. Otherwise, the method jumps back to the step 6.3.

In the following, in an example of a first printing element 2.3 it is explained in detail how the estimation of the energy quantity E ensues via the processing unit 1.4 in the determination step using the print parameter set.

The energy quantity $E_{p,a}$ to be supplied to the printing element 2.3 to be activated is a function of the temperature of the first printing element 2.3 necessary for the optimal melting of the ink particles and of the current temperature of the printing element 2.3. The closer the current temperature of the printing element 2.3 lies to the required optimal temperature of the first printing element 2.3, the less current energy quantity $E_{p,a}$ is to be supplied.

The current temperature of the printing element 2.3 is a function of the current temperature in its environment, which in the present case is detected by a temperature sensor 2.6 in the print head 2.1. Furthermore, it is a function of the relevant previous printing history of the printing element 2.3 and of both of its adjacent printing elements 2.4 and 2.5. If the printing element 2.3, or one of the two adjacent printing elements 2.4 and 2.5, was supplied with energy in a preceding feed step, a specific residual energy surplus from this is still present in the printing element 2.3, which specific residual energy surplus expresses itself as an increased temperature.

Since this residual energy surplus is comparably rapidly dissipated by heat transfer to the environment, in the present example it is sufficient only to account for the activation of the printing element 2.3 and its two adjacent printing elements 2.4 and 2.5 in the immediately preceding last activation sequence (i.e. the last printed print column) as well as the activation of the printing element 2.3 itself in the activation sequence before last (i.e. the penultimate printed print column) in order to achieve a sufficiently precise estimation of the required energy quantity $E_{p,a}$.

In other variants of the invention, however, consideration of the previous printing history can be provided that goes even further back in time, or less far back. This can in particular depend on the design of the print head, in particular the heat transfer rates predominating there.

In the determination step 6.7, the processing unit 1.4 estimates the current energy quantity $E_{p,a}$ to be supplied under consideration of the previous printing history of the printing element 2.3 and its two adjacent printing elements 2.4 and 2.5 according to the following energy quantity:

$$E_{p,a}=E_{max}-(s_{p,v}\cdot\Delta E_{p,v})-(s_{pnl,v}\cdot\Delta E_{pn,v})-(s_{pnr,v}\cdot\Delta E_{pn,v})-(s_{p,vv}\cdot\Delta E_{p,vv}), \quad (1)$$

wherein: $E_{max}$:energy that must be supplied to a printing element when no energy was supplied to it during the last and penultimate activation sequence and no energy was supplied to its immediate neighbors during the last activation sequence;

$\Delta E_{p,v}$: energy reduction for an activation of the printing element in the last activation sequence;

$\Delta E_{p,vv}$: energy reduction for an activation of the printing element in the penultimate activation sequence;

$\Delta E_{pn,v}$: energy reduction for an activation of an immediately adjacent printing element in the last activation sequence;

$s_{p,v}$: logical value of the activation of the printing element in the last activation sequence;

$s_{p,vv}$: logical value of the activation of the printing element in the penultimate activation sequence;

$s_{pnl,v}$: logical value of the activation of the printing element immediately adjacent to the left in the last activation sequence;

$s_{pnr,v}$: logical value of the activation of the printing element immediately adjacent to the right in the last activation sequence.

The logical values have the value "1" when the appertaining activation has actually occurred or the value "0" when the appertaining activation has not occurred. The logical values are protocolled by the processing unit 1.4 in the second memory 1.5. At every conclusion of a printing event, they are set to the value "0" by the processing unit 1.4 when it is assumed by this that the time to the next printing event is so long that the residual energy surplus would dissipate to the environment via heat transfer. If this is not the case, this reset can also correspondingly ensue with a time delay in order to also operate with the optimal energy quantities given a fast subsequent further print image.

In each determination step 6.7, the appertaining logical values for the printing elements to be considered are read out from the second memory 1.5. In the present case, 16 possible different previous history constellations with different values for the current energy quantity $E_{p,a}$ to be supplied thus result.

The energy reductions are calculated according to the following equations:

$$\Delta E_{p,v}=E_{max}-E_{p,v}, \tag{2}$$

$$\Delta E_{p,vv}=E_{pn,v}-E_{min}, \tag{3}$$

$$\Delta E_{pn,v}=\frac{E_{p,v}-E_{pn,v}}{2}, \tag{4}$$

wherein: $E_{max}$: energy that must be supplied to a printing element when no energy was supplied to it during the last and penultimate activation sequence and no energy was supplied to its immediate neighbors during the last activation sequence;

$E_{p,v}$: energy that must be supplied to a printing element when an activation of the printing element occurred in the last activation sequence;

$E_{pn,v}$: energy that must be supplied to a printing element when an activation of the printing element and both of its neighbors occurred in the last activation sequence;

$E_{min}$: energy that must be supplied to a printing element when an activation of the printing element and both of its neighbors occurred in the last activation sequence and an activation of the printing element occurred in the penultimate activation sequence.

The energy values $E_{max}$, $E_{p,v}$, $E_{pn,v}$ and $E_{min}$ thus represent energy supply values for different energy feed constellations in preceding energy feed steps, from which energy feed values the energy reductions for the respective previous printing histories can be determined.

The energy values $E_{max}$, $E_{p,v}$, $E_{pn,v}$, and $E_{min}$ represent print parameter values in the form of energy parameter values that are stored in the first print parameter set. In the present example, the print parameter set comprises a first partial parameter set in which are stored discrete energy values $E_{max}$, $E_{p,v}$, $E_{pn,v}$ and $E_{min}$ for two different feed speeds of the letter 4 and a series of different temperatures of the print head 2.1. Table 1 shows an example for this first partial parameter set.

TABLE 1

First Partial Parameter Set

| | | 10° C. | 20° C. | 30° C. | 40° C. | 50° C. | 55° C. |
|---|---|---|---|---|---|---|---|
| $E_{max}$ | 133 mm/s | 294 | 277 | 247 | 202 | 159 | 110 |
| [μJ] | 150 mm/s | 293 | 280 | 248 | 199 | 159 | 110 |
| $E_{p,v}$ | 133 mm/s | 179 | 168 | 160 | 136 | 109 | 80 |
| [μJ] | 150 mm/s | 183 | 168 | 156 | 136 | 109 | 80 |
| $E_{pn,v}$ | 133 mm/s | 135 | 120 | 104 | 104 | 81 | 60 |
| [μJ] | 150 mm/s | 125 | 108 | 104 | 97 | 79 | 60 |
| $E_{min}$ | 133 mm/s | 91 | 76 | 71 | 85 | 66 | 50 |
| [μJ] | 150 mm/s | 87 | 68 | 67 | 75 | 62 | 50 |

The energy values $E_{max}$, $E_{p,v}$, $E_{pn,v}$ and $E_{min}$ of the first partial parameter set are thereby matched to the ink ribbon cassette 3 or the ink ribbon 3.1, in particular the ink particles of the ink layer 3.2. They are furthermore matched to a specific type of print image to be generated, namely the generation of a two-dimensional barcode.

The first print parameter set comprises two more partial parameter sets whose energy values $E_{max}$, $E_{p,v}$, $E_{pn,v}$ and $E_{min}$ are likewise matched to the ink ribbon cassette 3 and the ink ribbon 3.1, respectively. These are a second partial parameter set that is furthermore matched to the generation of a one-dimensional barcode and a third partial parameter set that is furthermore watched to the generation of text and free graphics.

The temperature of the print head 2.1 and the feed speed of the letter 4 respectively represent a state parameter predominating in the region of the print head, which state parameters are incorporated into the determination of the current energy quantity $E_{p,a}$ to be supplied. The temperature of the print head 2.1 is detected with the temperature sensor 2.6 and relayed to the processing unit 1.5. The feed speed of the letter 4 is detected via the sensor 1.6 and likewise relayed to the processing unit 1.4.

It is understood that, in other variants of the invention, other state parameters that have a corresponding influence on the print result can be additionally or alternatively considered.

In the determination of the current energy quantity $E_{p,a}$, the processing unit 1.4. initially selects the corresponding partial parameter set corresponding to the type of the current print image to be generated. It then extracts the corresponding energy values $E_{max}$, $E_{p,v}$, $E_{pn,v}$ and $E_{min}$ from the selected partial parameter set using the values supplied by the temperature sensor 2.6 and the sensor 1.6.

For the case that the values of the temperature sensor 2.6 or, respectively, of the sensor 1.6 lie between the values of the selected partial parameter set, the processing unit 1.4 determines via linear interpolation an intermediate value for the respective energy value $E_{max}$, $E_{p,v}$, $E_{pn,v}$ and $E_{min}$.

It is understood that, in other variants of the invention, a different type of the determination of such intermediate values can also be provided. A correspondingly fine sub-division of the stored energy values $E_{max}$, $E_{p,v}$, $E_{pn,v}$ and $E_{min}$ can likewise also be provided, such that the determination of such intermediate values is unnecessary for an estimation with sufficient precision.

If the correct energy values $E_{max}$, $E_{p,v}$, $E_{pn,v}$ and $E_{min}$ have been determined in this manner, the processing unit still reads the logic values $s_{p,v}$, $s_{p,vv}$, $s_{pnl,v}$ and $s_{pnl}$, belonging to the printing element 2.3 from the second memory 1.5 and then calculates the current energy quantity $E_{p,a}$ to be supplied to the printing element 2.3 via the equations (1) through (4). This is then used for control of the printing element 2.3 as described above.

The described usage of energy parameter sets has the advantage that the processing unit 1.4 can quickly calculate the corresponding activation parameters from these, independent of the design of the print head 2.1, using corresponding characteristics of the print head 2.1 that can likewise be stored in the second memory. Alternatively, the energy supply device 2.2 can also be fashioned for this conversion, such that the processing unit 1.4 only has to transfer to the energy supply device 2.2 the current energy quantity $E_{p,a}$ to be supplied.

In the following, a further preferred embodiment of the inventive method for operating of a printer using a preferred embodiment of the inventive method for activation of a print head, which can be implemented with the printer 2 of FIG. 1, is described with reference to FIGS. 1 and 3.

The method workflow is initially started in a step 106.1. In a connection step 106.2, the ink ribbon cassette 3 is inserted into the franking machine 1 such that it is correctly associated with the print head 2.1. As described above, the first memory 3.4 is hereby automatically connected with the processing unit 1.4 via corresponding contact elements.

In a step 106.3, the processing unit 1.4 checks whether a reading of the print parameters from the first memory should ensue. This is the case when the described insertion of an ink ribbon cassette 3 has been detected as a first event. It is likewise established that the reading should ensue after each activation of the franking machine 1. The activation of the franking machine 1 thus likewise represents an event triggering the reading of the print parameters. It is understood that, in other variants of the invention, other temporal or non-temporal events can be defined that trigger the reading of the print parameters, as described above.

If the reading of the print parameters should ensue, in a read step 106.4 the processing unit 1.4 automatically reads the first print parameter set from the first memory 3.4. The processing unit stores the parameter set in a second memory 1.5 (in the form of a volatile working of the franking machine 1) connected with the processing unit 1.4. It is understood that, in other variants of the invention, the second memory 1.5 can be a non-volatile memory. Moreover, it can then also suffice to read the print parameters from the first memory 3.4 only at each detected insertion of an ink ribbon cassette.

In a step 106.5, it is checked whether a print process should be implemented, for example thus whether a letter 4 should be franked. If this is the case, the first printing element of the print head 2.1 to be activated according to the print image to be generated is initially selected in a step 106.6.

In a determination step 106.7, the processing unit 1.4 then estimates the optimal first energy quantity under access to the first print parameter set stored in the second memory, with which first energy quantity the selected printing element must be supplied in order to generate a qualitatively high-grade franking imprint on the letter 4. The estimation of the energy quantity was explained above in detail in connection with the exemplary embodiment from FIG. 2.

In a supply step 106.8, the processing unit 1.4 then controls the energy supply device 2.2 such that a corresponding first energy quantity is supplied to the selected printing element.

In other words, in the present example a determination of the first energy quantity ensues immediately before the activation of each printing element. This has the advantage that the temperature of the print head 2.1, which temperature is to be taken into account in the determination of the first energy quantity, enters into the determination with higher precision. Furthermore, the actual previous printing histories are considered, and not only the anticipated previous printing histories, meaning that the malfunction or omission of one or more activations can be detected and considered.

In a step 106.9, the processing unit then checks whether a further printing element of the print head 2.1 is to be activated. If this is the case, the process jumps back to step 106.6, in which the next printing element of the print head 2.1 to be activated is selected.

The printing ensues in columns. All printing elements of the print head 2.1 to be activated according to the print image to be generated are thereby activated in an activation sequence for generation of a print column. To generate the next print column, all printing elements of the print head 2.1 to be activated according to the print image to be generated are then activated in turn in a further activation sequence.

If no further printing element is to be activated, for example because all columns of the print image have been printed or a termination has occurred, in a step 106.10 it is finally checked whether the method workflow should be ended. If this is the case, the method workflow ends in a step 106.11. Otherwise, the method jumps back to the step 106.3.

The present invention was described in the preceding using two examples in which the energy quantities were either determined beforehand for the entire print image (FIG. 2) or were determined separately, immediately before the activation, for each individual activation of a printing element. It is understood that, in other variants of the invention, a procedure residing between these extreme variants can also be used. The determination of the energy quantities thus can ensue, for example, beforehand for the respective print column. The determination of the energy quantities can already ensue while the activation sequence for the preceding print column is still running, such that no noteworthy time loss is associated with this determination.

The present invention was described in the preceding using examples making use of energy parameter sets, but it is understood that, in other variants of the invention, arbitrary parameters that are relevant for determination of the correct activation values for the printing elements can be used as the print parameters. For example, these can be voltages and/or currents and/or pulse lengths that could be employed in a determination step immediately before activation of the printing elements.

Although the present invention was described in the preceding using examples with a franking machine, it is understood that the invention can also be used for many other applications.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for controlling supply of energy to respective printing elements of a thermotransfer print head to melt ink carried on an ink carrier of an ink carrier device to transfer said ink onto a print medium, said method comprising the steps of:

for a printing element of a thermotransfer head being used to print an image point of a print image, comprising a plurality of different print image types that, in at least one direction, respectively have different levels of sharpness and contrast, automatically electronically identifying a print image type, from among said plurality of print image types, that is to be printed at said image point; and automatically supplying an energy quantity to said printing element optimized to melt said ink to produce the sharpness and contrast of the identified print image type at said image point.

2. A method as claimed in claim 1 wherein said print image comprises a plurality of regions in which said respectively different print image types will be printed, and wherein the step of identifying said print image type comprises identifying the region in which said image point is disposed.

3. A method as claimed in claim 1 wherein said image point has a location in said print image, and wherein the step of supplying said energy quantity comprises supplying said energy quantity to said printing element using a print parameter set associated to the identified print image type to be printed at said location of said image point.

4. A method as claimed in claim 3 comprising generating said print parameter set as an energy parameter set.

5. A method as claimed in claim 1 comprising:

generating a partial parameter set for each of said different print image types;

combining said partial parameter sets to form a print parameter set; and supplying said energy quantity to said printing element using the partial parameter set within said print parameter set that is associated with the print image type at said image point.

6. A method as claimed in claim 1 comprising:

generating a determination algorithm for each of said different print image types; and supplying said energy quantity for said printing element using the determination algorithm associated with the print image type at said image point.

7. A method as claimed in claim 1 comprising:

electronically storing, in a memory, information that characterizes the energy quantity to be supplied to each printing element as a function of the print image type, among said plurality of image types, at each image point in said print image;

associating said memory with said ink carrier device; and supplying said energy quantity to said printing element by electronically reading said information from said memory and automatically electronically determining said energy quantity dependent on said information for said image point and the identified print image type.

8. A method as claimed in claim 7 wherein the step of associating said memory with said ink carrier device comprises physically attaching said memory to said ink carrier device.

9. A method as claimed in claim 7 wherein said image point will be printed at a region of said print head, and comprising:

electronically storing said information in said memory as a parameter set comprising a plurality of parameter subsets respective for said different print image types, and including in each parameter subset a print parameter as a function of at least one state parameter that predominates in said region.

10. A method as claimed in claim 9 comprising including, in each parameter subset, a plurality of different discrete values of said state parameter and, for each discrete value of said state parameter, an associated value of said print parameter.

11. A method as claimed in claim 10 comprising, if said state parameter predominating in said region is between two of said discrete values, automatically electronically interpolating a value for said print parameter from values of said print parameter respectively associated with said two of said discrete values of said state parameter.

12. A method as claimed in claim 9 comprising selecting said state parameter from the group of parameters consisting of temperature in said region, movement speed of said print medium relative to said printing element, and movement speed of said print medium relative to said ink carrier device.

13. A method as claimed in claim 1 comprising, for each printing of a print image, supplying said energy quantity to said printing element in a feed step, and supplying said energy quantity for said printing element in a current feed step additionally dependent on an energy quantity supplied to that printing element in at least one preceding feed step that precedes said current feed step.

14. A method as claimed in claim 13 comprising selecting said preceding feed step from the group of preceding feed steps consisting of an immediately preceding feed step and a penultimate preceding feed step.

15. A method as claimed in claim 1 comprising, for each printing of said print image, supplying said energy quantity to said print element in a feed step, and comprising, for a current feed step, supplying said energy quantity for said printing element additionally dependent on an energy quantity supplied to a further printing element, neighboring said printing element in said thermotransfer print head, in a preceding feed step that precedes said current feed step.

16. A method as claimed in claim 15 comprising selecting said preceding feed step from the group of preceding feed steps consisting of an immediately preceding feed step and a penultimate preceding feed step.

17. A method as claimed in claim 1 comprising, for each printing of said print image, supplying an energy quantity to said printing element in a feed step and comprising, for a current feed step, supplying said energy quantity for said printing element additionally dependent on a plurality of feed constellations of energy quantities in at least one feed step preceding said current feed step.

18. A method as claimed in claim 1 comprising, for each printing of said print image, supplying an energy quantity to said printing element in a feed step and comprising, for a current feed step, supplying said energy quantity by reducing a predetermined maximum energy quantity by an amount dependent on an energy quantity supplied to said printing element in at least one feed step preceding said current feed step.

19. A printer comprising:

a thermotransfer print head having a plurality of individually actuatable printing elements;

an ink carrier device comprising an ink carrier carrying ink thereon, said ink carrier device being disposed at a position to interact with said printing elements of said print head, said printing elements of said print head, when individually activated, melting said ink carried on said ink carrier to transfer said ink onto a print medium to print an image point; and a processing unit connected to said thermotransfer print head configured to individually actuate said printing elements to respectively print image points forming a print image on said print medium comprising a plurality of print image types that, in at least one direction, respectively have different levels of sharpness and contrast, said processing unit being configured to activate at least one of said printing elements by identifying a print image type, from among said plurality of print image types, at the image point to be printed by the actuated printing elements, and automatically supplying an energy quantity thereto optimized to melt said ink to produce the sharpness and contrast of the identified print image type at the image point to be printed by the printing element.

20. A printer as claimed in claim 19 wherein said print image comprises a plurality of regions in which respectively different print image types will be printed, and wherein said processing unit is configured to identify said print image type dependent on the region in which the image point is disposed.

21. A printer as claimed in claim 19 wherein said image point has a location in said print image, and wherein said processing unit is configured to supply said energy quantity by using a print parameter set associated to the print image type to be printed at said location of said image point.

22. A printer as claimed in claim 21 wherein said processing unit generates said print parameter set as an energy parameter set.

23. A printer as claimed in claim 19 wherein said processing unit is configured to generate a parameter subset for each of said different print image types, to combine said parameter subsets to form a print parameter set for said print image, and to supply said energy quantity to said printing element using the parameter subset, within said print parameter set, that is associated with the print image type at said image point.

24. A printer as claimed in claim 19 wherein said processing unit is configured to generate a determination algorithm for each of said different print image types, and to supply said energy quantity to said printing element using the determination algorithm associated with the print image type at the image point.

25. A printer as claimed in claim 19 comprising a memory associated with said ink carrier device containing information that characterizes the energy quantity to be supplied to each printing element as a function of the print type, among said plurality of print types, for each image point in said print image, and wherein said processing unit is configured to supply said energy quantity to said printing element by electronically reading said information from said memory and automatically supplying said energy quantity dependent on said information.

26. A printer as claimed in claim 25 wherein said memory is physically attached to said ink carrier device.

27. A printer as claimed in claim 25 wherein said memory has said information electronically stored therein as a parameter set comprising a parameter subset for each print image type, each parameter subset including a print parameter as a function of at least one state parameter that predominates in said region.

28. A printer as claimed in claim 27 wherein in each parameter subset includes a plurality of different discrete values of said state parameter and, for each discrete value of said state parameter, an associated value of said print parameter.

29. A printer as claimed in claim 28 wherein said processing unit, if said state parameter predominating in said region is between two of said discrete values, is configured to automatically interpolate a value for said print parameter from values of said print parameter respectively associated with said two of said discrete values of said state parameter.

30. A printer as claimed in claim 27 wherein said state parameter is parameter selected from the group of parameters consisting of temperature in said region, movement speed of said print medium relative to said printing element, and movement speed of said print medium relative to said ink carrier device.

31. A printer as claimed in claim 19 wherein said processing unit, for each printing of a print image, is configured to supply said energy quantity to said printing element in a feed step, and to supply said energy quantity for said printing element in a current feed step additionally dependent on an energy quantity supplied to that printing element in at least one preceding feed step that precedes said current feed step.

32. A printer as claimed in claim 31 wherein said processing unit is configured to use, as said preceding feed step, a preceding feed step selected from the group of preceding feed steps consisting of an immediately preceding feed step and a penultimate preceding feed step.

33. A printer as claimed in claim 19 wherein said processing unit, for each printing of said print image, is configured to supply said energy quantity to said print element in a feed step, and, for a current feed step, to supply said energy quantity for said printing element additionally dependent on an energy quantity supplied to a further printing element, neighboring said printing element in said thermotransfer print head, in a preceding feed step that precedes said current feed step.

34. A printer as claimed in claim 33 wherein said processing unit is configured to use, as said preceding feed step, a preceding feed step selected from the group of preceding feed steps consisting of an immediately preceding feed step and a penultimate preceding feed step.

35. A printer as claimed in claim 19 wherein said processing unit, for each printing of said print image, is configured to supply an energy quantity to said printing element in a feed step and, for a current feed step, to supply said energy quantity for said printing element additionally dependent on a plurality of feed constellations of energy quantities in at least one feed step preceding said current feed step.

36. A printer as claimed in claim 19 wherein said processing unit, for each printing of said print image, is configured to supply an energy quantity to said printing element in a feed step and, for a current feed step, and to supply said energy quantity by reducing a predetermined maximum energy quantity by an amount dependent on an energy quantity supplied to said printing element in at least one feed step preceding said current feed step.

37. A franking machine comprising:

a thermotransfer print head having a plurality of individually actuatable printing elements;

an ink carrier device comprising an ink carrier carrying ink thereon, said ink carrier device being disposed at a position to interact with said printing elements of said print head, said printing elements of said print head, when individually activated, melting said ink carried on said ink carrier to transfer said ink onto a print medium to print an image point;

a security module containing security information required by a governmental authority to be embedded in a franking imprint; and a processing unit connected to said thermotransfer print head and to said security module for individually actuating said printing elements respectively to print image points forming a franking imprint on said print medium comprising at least one print image type, and embodying said security information, said processing unit actuating at least one of said printing elements by determining an energy quantity for supply to said one of said printing elements dependent on the print image type at the image point that will be printed by the printing element.

38. An ink carrier device comprising:

a device body adapted to be placed adjacent a thermotransfer print head comprising a plurality of individually actuatable printing elements;

an ink carrier disposed in said device body, carrying ink adapted to be melted dependent on energy supplied to individual ones of said printing elements to transfer said ink onto a print medium to print respective image points of a print image comprising at least one print image type; and a memory attached to said carrier body containing information that is specifically characteristic of said ink carrier device with regard to melting of said ink for printing the print image type at each image point.

* * * * *